US005284113A

United States Patent [19]

Svensson

[11] Patent Number: 5,284,113

[45] Date of Patent: Feb. 8, 1994

[54] ARRANGEMENT IN AN I. C. ENGINE

[75] Inventor: Ulf M. Svensson, Trollhättan, Sweden

[73] Assignee: Aktiebolaget Electrolux, Sweden

[21] Appl. No.: 943,293

[22] Filed: Sep. 10, 1992

[30] Foreign Application Priority Data

Sep. 11, 1991 [SE] Sweden ..... 9102629-4

[51] Int. Cl.[5] ..... F02M 7/00

[52] U.S. Cl. ..... 123/344; 123/436

[58] Field of Search ..... 123/344, 436, 416, 417, 123/419

[56] References Cited

U.S. PATENT DOCUMENTS 4,047,507 9/1977 Noguchi et al. ..... 123/344
4,550,701 11/1985 Suzuki et al. ..... 123/436
5,018,498 5/1991 Hoover ..... 123/436
5,101,791 4/1992 Kuethner et al. ..... 123/436

FOREIGN PATENT DOCUMENTS 0297670 6/1988 European Pat. Off. ..... 123/436
4513339 9/1928 Sweden ..... 123/436

*Primary Examiner*—Raymond A. Nelli
*Attorney, Agent, or Firm*—Pearne, Gordon, McCoy & Granger

[57] ABSTRACT

A two cycle i. c. engine adjusted to a certain maximum engine speed at a correct fuel mixture ratio is provided with an electrically adjustable fuel system and a tachometer. The invention is based on the fact that the engine speed is at its maximum at a mixture ratio which provides a carbon monoxide emission below normal. At the maximum engine speed the adjustment of the carburetor is optimized in relation to the mixture ratio by means of a control circuit.

2 Claims, 2 Drawing Sheets

ARRANGEMENT IN AN I. C. ENGINE

The present invention relates to an arrangement in a two-cycle internal combustion or i. c. engine provided with adjusting means for the air/fuel ratio (A/F) and inlet, flushing, and outlet ports in the cylinder wall, a control unit having a tachometer and control means for electro-mechanical control of the A/F adjusting means, and means for determining the maximum engine speed.

The object of the present invention is to provide an arrangement in the carburetor of an i. c. engine for adjusting the carburetor to the most favourable possible air-fuel mixture in order to reduce the emissions of carbon oxide and hydrocarbon.

Internal combustion engines produce undesirable emissions of exhaust gases the composition of which is influenced by the air-fuel mixture of the engine. For each engine there is an optimal composition of said mixture for providing the lowest possible emissions. An old and well-known method of adjusting the carburetor of, for example, a chain saw engine, is to run the engine at full throttle with the friction of the saw chain as load and adjust the mixture ratio of the carburetor so as to obtain maximum engine speed. The engine speed is at its maximum at a certain mixture ratio and is decreased at both richer and leaner mixtures. However, the free runaway engine speed of modern chain saws is too high to allow this method to be used in practice, from the point of view of safety. The carburetor is therefore normally adjusted such that the engine speed is considerably below its maximum by setting the mixture ratio to the rich side. To obtain this the operator must know the function of the carburetor adjustment, i.e. which direction of the adjusting screw that provides richer mixture. In order to limit the top speed of a moped a tuned exhaust gas pipe has been provided with the result that the power is drastically reduced at high engine speed, and the maximum engine speed is consequently reduced, too. In this case the engine has a gas dynamic tuning and an overrich combustion gas need not be used to keep the engine speed down.

The invention provides an arrangement for automatic adjustment of the carburetor in which the maximum of the engine speed, but not its absolute value, is used as control parameter. The theory of the operation of the arrangement is best described by the following figures illustrating various parameters of a small two cycle engine.

FIG. 1 illustrates the variation of the output power of the engine in relation to the mixture ratio A/F. The optimal power adjustment occurs at the top of the graph.

FIG. 2 shows the variation of the output power in relation to the engine speed. The continuous graph applies to a correct A/F and the dotted to an enriched adjustment. The Figure also has a dashed line showing the load (the friction of the saw chain) which at the intersections of the graphs shows the respective runaway engine speeds.

An engine can be designed for a limited engine speed by reducing the time periods available for inlet, flushing and exhaustion. It is then possible to maintain a correct mixture ratio A/F even at high speed. It is necessary, however, that the adjustment at maximum speed be repeated at even intervals to enable the engine to operate at a correct A/F ratio at all times. This has been made possible due to an electromechanical adjusting means actuating the fuel nozzle, needle, or fuel passage of the carburetor. At runaway engine speed a control circuit or a computer takes over the duty of optimizing the adjustment at maximum speed. This is obtained by the arrangement mentioned in the introduction which according to the invention is characterized in that the primary circuit of of the ignition coil of the ignition system of the engine is utilized as pulse transducer for the tachometer, a differential circuit being connected to said tachometer for providing the derivative of the engine speed function, and a starting pulse circuit is connected to said control means and operable in relation to digital circuits connected to said differential circuit and to different branches of said control means and adapted to increase and reduce said A/F ratio, respectively, resulting in a corresponding variation of the engine speed, and a peak memory being connected to said tachometer to provide a final setting of said adjusting means at said maximum engine speed.

Figure 5:
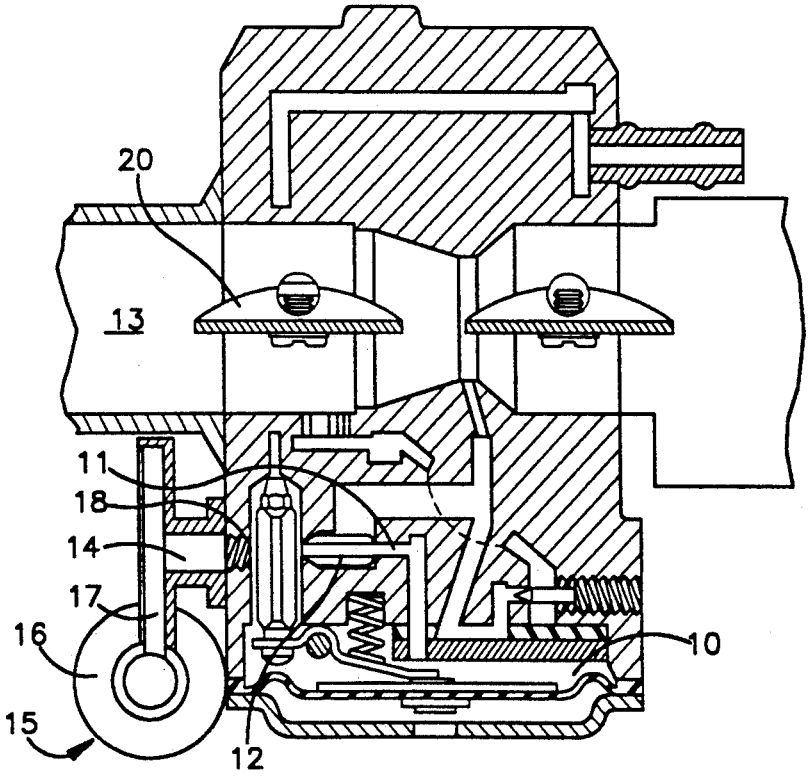
FIG. 5 is a carburetor with an adjusting means for the A/F mixture ratio.

The carburetor of FIG. 5 is a so-called membrane carburetor used, for example, in chain saws. A fuel chamber 10 is filled with fuel which is successively drawn in through a nozzle 11 provided with a nozzle 12 to a through gas passage 13. The needle is an elongation of a shaft 14 of an electromechanic adjusting means 15 comprising an electric motor 16 and an angled gear 17. The shaft is threadedly engaged in a bore 18 in the carburetor housing whereby a rotation by means of the electronic motor results in a displacement of the needle in the opening of the nozzle. The fuel flow through the nozzle is thereby controlled.

Figure 1:
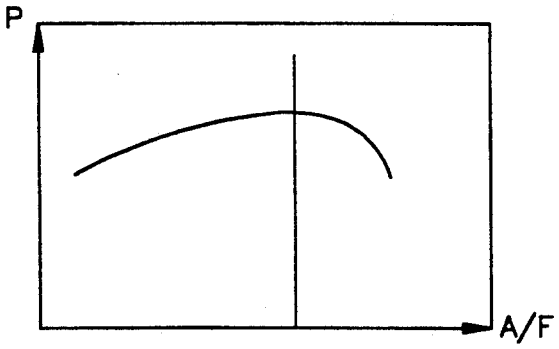
Figure 2:
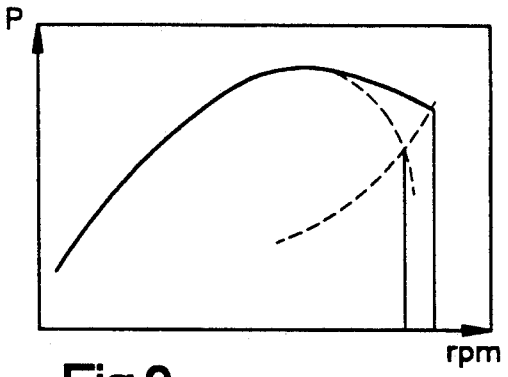
Figure 3:
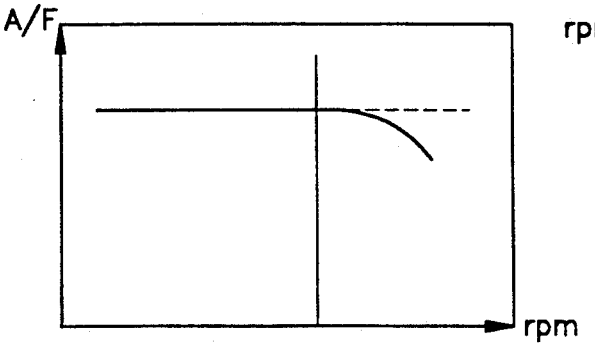
FIG. 3 illustrates a carburetor characteristic which according to the above is necessary in modern engines having a high engine speed. The dashed line shows a constant A/F and the continuous line the enriched carburetor adjustment providing a lower engine speed.
Figure 4:
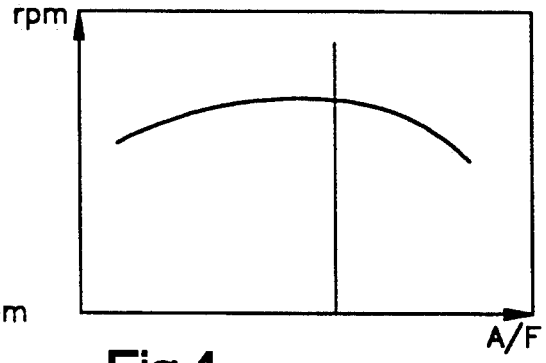
FIG. 4 shows the engine speed varies with A/F. The top portion of the graph shows the maximum engine power.

By reducing the time periods available at the ports for inlet, flushing and exhaustion until an appropriate maximum engine speed is obtained it is possible to maintain a constant mixture ratio even at an engine speed approaching this maximum speed (FIG. 3).

The adjusting needle 12 of the fuel nozzle and the shaft 14 can be made as a self-braking screw. It is rotated by the electric motor which in turn is controlled by a control unit 19 or a computer. The control unit optimizes the fuel amount during a sufficiently long period of free rush with the gas throttle fully open so that a maximum engine speed is reached. The speed is metered by an electronic tachometer 21 connected to the ignition system. As the shaft 14 is self-braking the performed setting will be maintained when the engine is disconnected from the control unit. The carburetor maintains this setting until the next adjustment even if the engine is shut off and the system becomes currentless.

Figure 6:
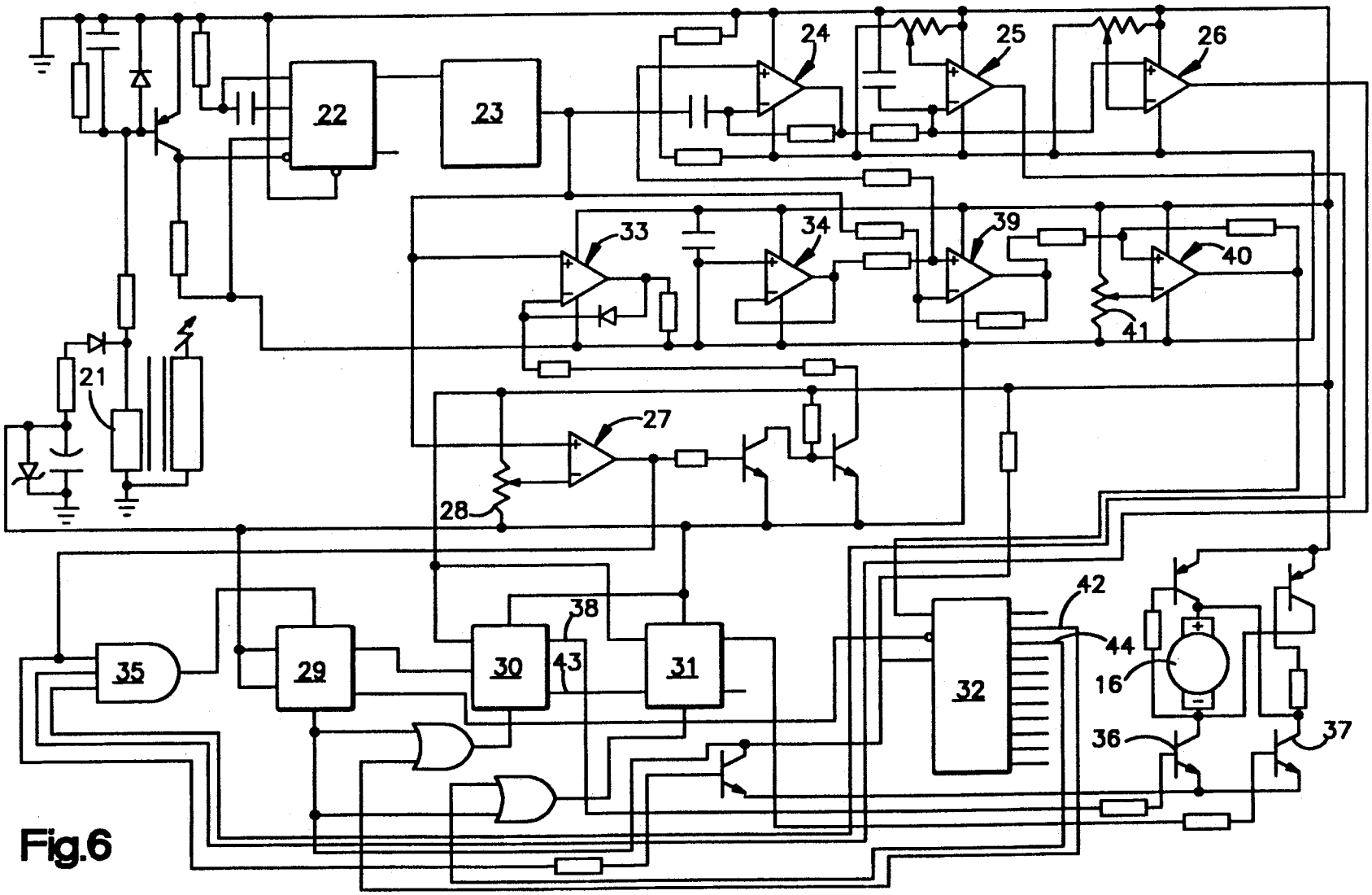
FIG. 6 is a circuit diagram of the arrangement.

For the sake of completeness FIG. 6 shows a diagram of the control unit with the drive circuit for the electric motor. The diagram shows a connection based on analog and digital components. A control unit for maximum speed calibration is shown which is connected to the ignition coil of the engine (magnetic ignition system) in which the primary winding 21 provides the current supply to the control unit and operates as a pulse transducer for the tachometer. The function of the unit implies triggering at a zero crossing of the primary current between the first negative pulse and the first positive. A mono rocker 22 having a pulse length of about 3 ms prevents false triggering. A frequency/voltage converter 23 converts the speed value to another low signal. This signal is derived in a deriving circuit 24 and the derivative is supplied to two comparators 25, 26 the outlets of which form "1:s" (high level) when the speed is stable, i.e. when the derivative is zero. Another comparator 27 is supplied with the same analog signal and provides an output "1" when the speed exceeds a predetermined level which can be selected by a potentiometer 28. When the speed is below e.g. 8000 rpm, a number of digital circuits 29, 30, 31, 32 and an analog peak value memory 33, 34 are set to zero.

The calibration starts when the the speed is above the predetermined (8000 rpm) and the comparators 25, 26, 27 provide "1:s". An AND-gate 35 then provides a start pulse to the circuit 29 which is a mono rocker, whereby a clock pulse is supplied to the circuit 30 which is also a rocker.

The electric motor 16 is provided with drive circuits in a conventional connection which need not be described in further detail. The essential feature is that the closing of a switch 36 causes the motor to start in one direction, and the closing of another switch 37 starts the motor in the opposite direction.

An outlet 38 of the rocker 30 leads to the switch 36 which starts the electric motor in the direction providing a richer gas mixture. The possibility of performing the calibration is based on the feature that the speed of the i. c. engine is reduced both when the gas mixture is too rich and too lean. Enrichment of the mixture thus results in a speed reduction. A differential amplifier 39 measures the difference between the maximum peak value from the peak value memory 33, 34 and the actual value. The result of the measurement is supplied to a subsequent comparator 40 the output of which is "1" when the difference exceeds a certain value that can be pre-set on a potentiometer 41, e.g. 200 rpm. By the value "1" from the comparator 40 a decade counter 32 is clocked and emits "1" at an outlet 42 connected to to rocker 30 which is then set to zero. The switch 36 disconnects the current to the electric motor which consequently stops. The other outlet 43 of the rocker assumes the value "1" which is supplied to the circuit 31, a rocker with the purpose of starting the electric motor via the switch 37 in the opposite direction which provides a leaner gas mixture.

The enrichment of the gas caused by the previous adjustment ceases and the engine speed can be expected to increase. As a consequence, the value "1" from the comparator 40 drops out as the speed difference disappears. The leaner and leaner mixture, however, results in a reduction of the engine power and the speed drops again. When the drop is 200 rpm below the maximum peak value the comparator 40 resumes the value "1" and now clocks the counter one step to "1" at outlet 44. This outlet leads to the rocker 31 which is set to zero. The switch 37 disconnects the current whereby the electric motor stops. When the differential amplifier 39 measures a difference between the peak value memory and the actual speed that is big enough for the comparator to produce "1", the adjustment is terminated as optimal. Another method of discontinuing the adjustment is that the gas control be released by the operator whereby the speed drops below the predetermined value, i.e. 8000 rpm.

In an apparatus such as a chain saw it is also possible to use a micro computer for controlling a number of functions, i.e., the maximization of the engine speed. In this variation of the invention said function is inherent as a part of a program which will not be disclosed in more detail here. However, a portion of the computer must be considered to constitute a control unit, and therefore this variant should be considered to be an integral part of the invention.

I claim:

1. Arrangement in a two-cycle internal combustion engine provided with means (11, 12) for adjusting a ratio of air to fuel (A/F), a control unit (19) having a tachometer (21) and control means (36, 37) for electromechanical control of the adjusting means, and means (30, 31, 33, 34) for determining a maximum engine speed, wherein a primary circuit (21) of an engine ignition coil is utilized as a pulse transducer for the tachometer, a differentiating circuit (24) is connected to said tachometer for providing the derivative of the engine speed function, and a starting pulse circuit (35) is connected to said control means and operable in relation to digital circuits (29, 30, 31) connected to said differentiating circuit and to different branches of said control means adapted to increase and reduce the air to fuel ratio, respectively, resulting in a corresponding variation of the engine speed, and a peak value memory (33, 34) is connected to said tachometer to provide a final setting of said adjusting means at said maximum engine speed.

2. Arrangement according to claim 1, wherein current supply to the control circuit is provided by a primary circuit of the engine ignition coil.

* * * * *

UNITED STATES PATENT AND TRADEMARK OFFICE

CERTIFICATE OF CORRECTION

PATENT NO. : 5,284,113

DATED : February 8, 1994

INVENTOR(S) : Ulf M. Svensson

It is certified that error appears in the above-indentified patent and that said Letters Patent is hereby corrected as shown below:

Column 1, line 28, delete "runaway" and insert --rush--; and
line 66, after "shows" insert --how--.

Column 2, line 28, after "peak" insert --value--;
line 34, delete "nozzle" and insert --needle--; and
line 40, delete "electronic" and insert --electric--.

Column 3, lines 16 and 17, delete "an analog peak value memory 33, 34" and insert --a hold circuit 34a--;
line 17, after "zero." insert --The hold circuit 34a includes a pair of op-amps 33 and 34.--;
line 38, delete "peak value memory" and insert --hold circuit 34a--; and
line 44, delete "to" and insert --the--.

Column 4, line 35, (Claim 1, line 6) delete "(30, 31, 33, 34)" and insert --(30, 31, 32, 33, 34)--; and
lines 46 and 47, (claim 1, lines 17 and 18) delete "peak value memory (33, 34)" and insert --hold circuit (34a)--.

Signed and Sealed this

Eighteenth Day of April, 1995

Bruce Lehman

*Attest:*

BRUCE LEHMAN

*Commissioner of Patents and Trademarks*

*Attesting Officer*